US009289633B2

(12) United States Patent
Walker et al.

(10) Patent No.: US 9,289,633 B2
(45) Date of Patent: Mar. 22, 2016

(54) SYSTEMS AND METHODS FOR INFLATABLE AVALANCHE PROTECTION

(75) Inventors: Joseph Benjamin Walker, Draper, UT (US); David K Blackwell, Murray, UT (US); Derick J. Noffsinger, Salt Lake City, UT (US); James Thomas Grutta, Sandy, UT (US); Nathan Miles Kuder, Park City, UT (US); Peter Thomas Gompert, Huntsville, UT (US); Robert John Horacek, Park City, UT (US)

(73) Assignee: Black Diamond Equipment, Ltd., Salt Lake City, UT (US)

( * ) Notice: Subject to any disclaimer, the term of this patent is extended or adjusted under 35 U.S.C. 154(b) by 304 days.

(21) Appl. No.: 13/324,840

(22) Filed: Dec. 13, 2011

(65) Prior Publication Data

US 2013/0149923 A1 Jun. 13, 2013

(51) Int. Cl.

| | |
|---|---|
| ***B63C 9/18*** | (2006.01) |
| ***A62B 33/00*** | (2006.01) |
| ***A62B 17/00*** | (2006.01) |

(52) U.S. Cl.

CPC ..... *A62B 33/00* (2013.01); *A62B 17/00* (2013.01); *B63C 9/18* (2013.01)

(58) Field of Classification Search

CPC ..... B64B 1/40; B63C 9/18; B63C 9/00; A62B 17/00; A45F 3/04

USPC ..... 441/80, 82, 92, 93; 116/209, 210; 224/153, 155, 580, 582

See application file for complete search history.

(56) References Cited

U.S. PATENT DOCUMENTS

| | | | | | |
|---|---|---|---|---|---|
| 3,768,467 | A * | 10/1973 | Jennings | 441/38 |
| 4,031,674 | A * | 6/1977 | Rand | 52/2.14 |
| 4,920,674 | A * | 5/1990 | Shaeffer | 116/210 |
| 4,943,252 | A * | 7/1990 | Manix | 441/87 |
| 6,158,380 | A * | 12/2000 | Aschauer et al. | 116/210 |
| 6,220,909 | B1 * | 4/2001 | Aschauer et al. | 441/80 |
| 7,270,077 | B2 * | 9/2007 | Beck | 116/210 |
| 8,123,581 | B2 * | 2/2012 | Aschauer | 441/80 |
| 8,876,568 | B2 * | 11/2014 | Blenkarn et al. | 441/80 |
| 2012/0060267 | A1 † | 3/2012 | Blenkarn | |

* cited by examiner
† cited by third party

*Primary Examiner* — Lars A Olson
(74) *Attorney, Agent, or Firm* — Trent Baker; Baker & Associates PLLC

(57) ABSTRACT

One embodiment of the present invention relates to an avalanche safety system including an inflatable chamber, activation system, inflation system, and a harness. The inflatable chamber is a three-dimensionally, partially enclosed region having an inflated state and a compressed state. The inflated state may form a particular three dimensional shape configured to protect the user from burial and provide flotation during an avalanche. The activation system is configured to receive a user-triggered action to activate the system. The inflation system may include an air intake, battery, fan, and internal airway channel. The inflation system is configured to transmit ambient air into the inflatable chamber. The harness may be a backpack that enables a user to transport the system while engaging in activities that may be exposed to avalanche risk. The harness may include hip straps, shoulder straps, internal compartments, etc.

15 Claims, 9 Drawing Sheets

SYSTEMS AND METHODS FOR INFLATABLE AVALANCHE PROTECTION

FIELD OF THE INVENTION

The invention generally relates to inflatable avalanche safety systems and methods of operation. In particular, the present invention relates to systems and methods for efficient inflation of an avalanche safety chamber.

BACKGROUND OF THE INVENTION

One type of emergency life-preserving equipment is an inflatable safety system configured to inflate a chamber in response to an emergency event such as an impact or a potential impact. For example, automobile driver inflatable safety systems are designed to automatically inflate a chamber over the steering wheel in response to an impact between the automobile and another object so as to protect the driver from forceful impact with the interior of the automobile. Likewise, avalanche inflatable safety systems are designed to manually inflate a chamber that adjacent to the user in response to the user's triggering of an inflation mechanism. Inflatable safety systems generally include an inflatable chamber, an activation system, and an inflation system. The inflatable chamber is designed to expand from a compressed state to an inflated state so as to cushion the user or dampen potential impact. The inflatable chamber may also be used to encourage the user to elevate over a particular surface. The elevation of the inflatable chamber is achieved by reverse segregation in which larger volume particles are sorted towards the top of a suspension of various sized particles in motion. The activation system enables manual or automatic activation of the inflation system. The inflation system transmits a fluid such as a gas into the inflatable chamber, thus increasing the internal pressure within the inflatable chamber and thereby transitioning the inflatable chamber from the compressed state to the inflated state.

Unfortunately, conventional inflatable avalanche safety systems fail to provide an efficient safety system. First, conventional systems are limited to single use in-field operation. The portable compressed gas canisters used in the conventional systems are generally configured to only contain a sufficient volume for a single deployment and therefore must be completely replaced to rearm the system. Therefore, if a user inadvertently deploys the system, it cannot be rearmed without replacing the canister. Second, conventional systems include one or more combustible or pressurized components that are not permitted on airplanes and helicopters, thus limiting the systems' use in travel situations. Third, conventional avalanche inflatable systems require a complex rearming procedure that includes replacing at least one component to enable subsequent use after activation. This may compromise user safety or system operation if performed incorrectly.

Therefore, there is a need in the industry for an efficient and reliable inflatable avalanche safety system that overcomes the problems with conventional systems.

SUMMARY OF THE INVENTION

The present invention generally relates to inflatable avalanche safety systems and methods of operation. One embodiment of the present invention relates to an avalanche safety system including an inflatable chamber, activation system, inflation system, and a harness. The inflatable chamber is a three-dimensionally, partially enclosed region having an inflated state and a compressed state. The inflated state may form a particular three dimensional shape configured to protect the use from impact and/or provide flotation during an avalanche. The activation system is configured to receive a user-triggered action to activate the system. The inflation system may include an air intake, battery, fan, and internal airway channel. The inflation system is configured to transmit ambient air into the inflatable chamber. The harness may be a backpack that enables a user to transport the system while engaging in activities that may be exposed to avalanche risk. The harness may include hip straps, shoulder straps, internal compartments, etc.

Embodiments of the present invention represent a significant advance in the field of avalanche safety systems. Embodiments of the present invention avoid the limitations of conventional avalanche safety systems by using ambient air rather than a canister of compressed gas. The use of ambient air avoids the explosive dangers associated with compressed gas canisters and thereby is legal for air transportation. Likewise, ambient air is unlimited and therefore enables multiple inflations and/or inadvertent deployments. Finally, the procedure to rearm the system is simplified to enable intuitive user operation.

These and other features and advantages of the present invention will be set forth or will become more fully apparent in the description that follows and in the appended claims. The features and advantages may be realized and obtained by means of the instruments and combinations particularly pointed out in the appended claims. Furthermore, the features and advantages of the invention may be learned by the practice of the invention or will be obvious from the description, as set forth hereinafter.

BRIEF DESCRIPTION OF THE DRAWINGS

The following description of the invention can be understood in light of the Figures, which illustrate specific aspects of the invention and are a part of the specification. Together with the following description, the Figures demonstrate and explain the principles of the invention. In the Figures, the physical dimensions may be exaggerated for clarity. The same reference numerals in different drawings represent the same element, and thus their descriptions will be omitted.

DETAILED DESCRIPTION OF THE INVENTION

The present invention generally relates to inflatable avalanche safety systems and methods of operation. One embodiment of the present invention relates to an avalanche safety system including an inflatable chamber, activation system, inflation system, and a harness. The inflatable chamber is a three-dimensionally, partially enclosed region having an inflated state and a compressed state. The inflated state may form a particular three dimensional shape configured to protect the use from impact and/or provide flotation during an avalanche. The activation system is configured to receive a user-triggered action to activate the system. The inflation system may include an air intake, battery, fan, and internal airway channel. The inflation system is configured to transmit ambient air into the inflatable chamber. The harness may be a backpack that enables a user to transport the system while engaging in activities that may be exposed to avalanche risk. The harness may include hip straps, shoulder straps, internal compartments, etc. Also, while embodiments are described in reference to an avalanche safety system it will be appreciated that the teachings of the present invention are applicable to other areas including but not limited to non-avalanche impact safety systems.

Figure 1:
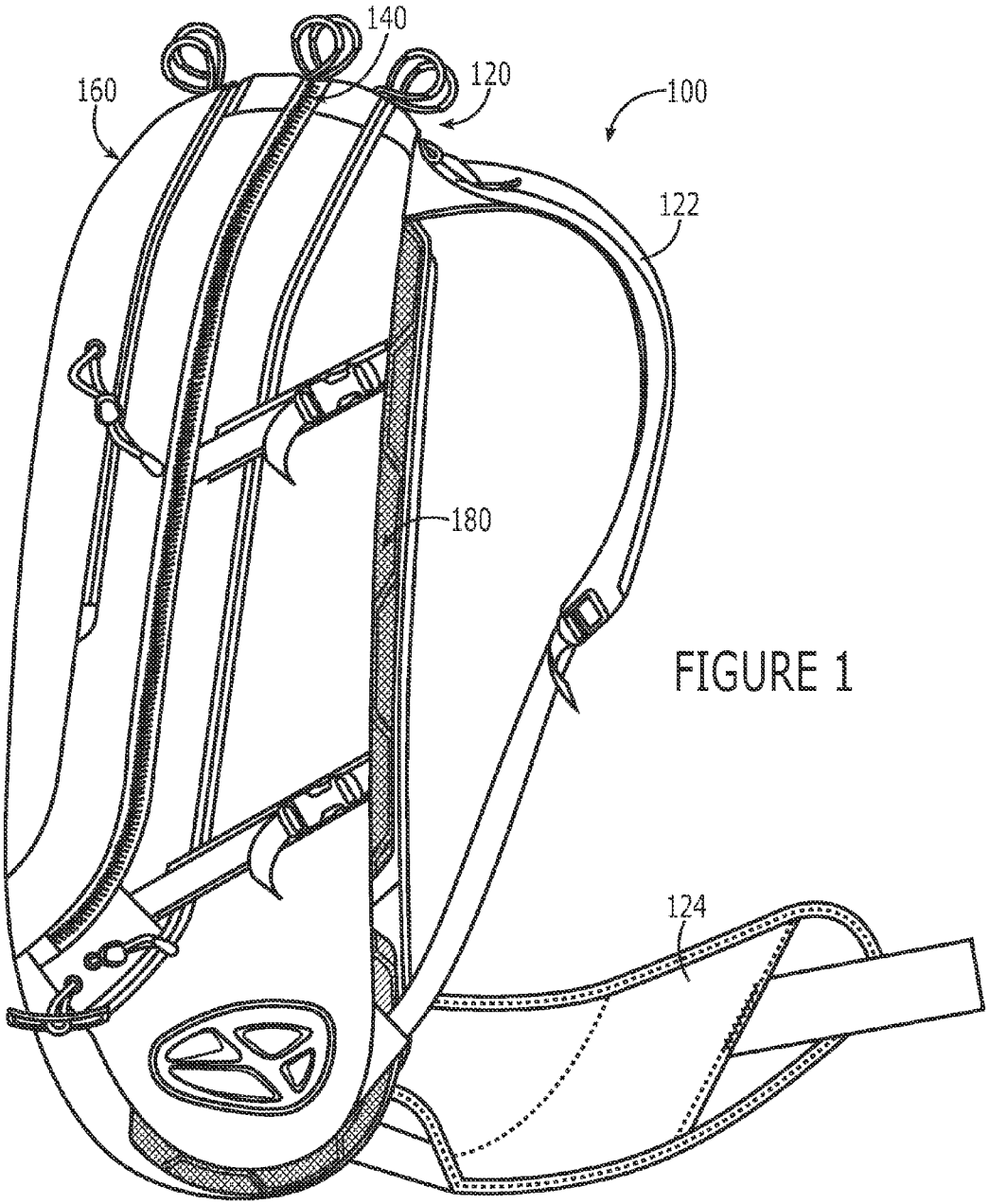
FIG. 1 illustrates a profile view of an avalanche safety system in accordance with embodiments of the present invention.

Reference is initially made to FIG. 1, which illustrates a profile view of an avalanche safety system, designated generally at 100. The illustrated system 100 includes an inflatable chamber 140, an inflation system 160, an activation system (not shown), and a harness 120. The inflatable chamber 140 is a three dimensional, inflatable, partially enclosed structure. In particular, the inflatable chamber 140 includes an inlet (not shown) and a particular inflated shape. The inflatable chamber 140 is illustrated in the compressed state in FIG. 1. The compressed state includes substantially expelling air from within the inflatable chamber and compressing the external surface of the inflatable chamber upon itself. FIG. 7C illustrates the inflated state of the inflatable chamber. The inflated state of the inflatable chamber includes expanding the external surface apart from itself substantially analogous to the inflation of a balloon. However, the inflatable chamber may include a particular three dimensional inflated shape such that upon inflation, the external surfaces are forced to form the shape. For example, the inflatable chamber may be configured to include multiple chambers, multiple regions, etc. FIG. 7C illustrates on embodiment of an inflated shape including a substantially pillow-shaped form with two horn members. It will be appreciated that various other shapes may be practiced in accordance with embodiments of the present invention. For example, the inflatable chamber 140 may be configured to wrap around the head and/or torso of the user.

Figure 2:
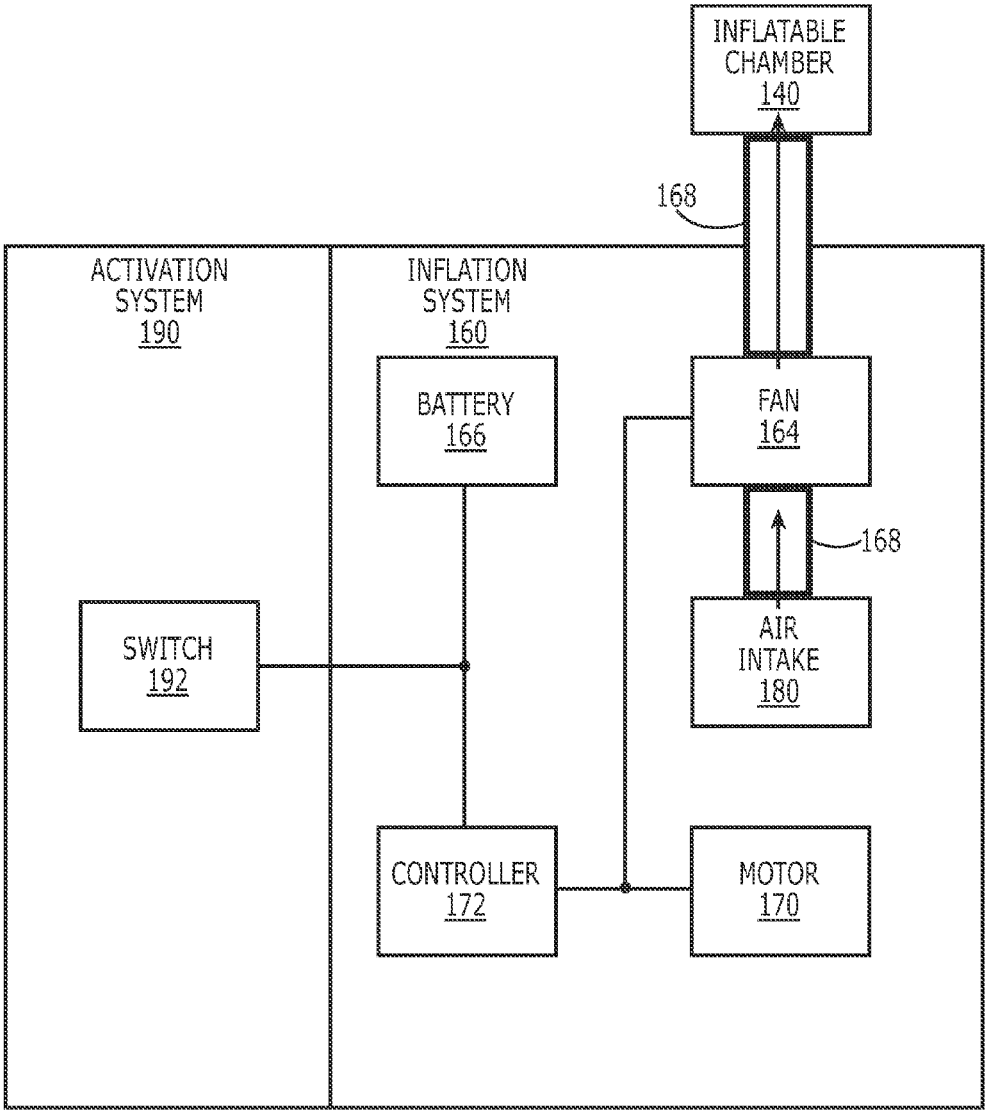
FIG. 2 illustrates a schematic of the avalanche safety system illustrated in FIG. 1.
Figure 3A:
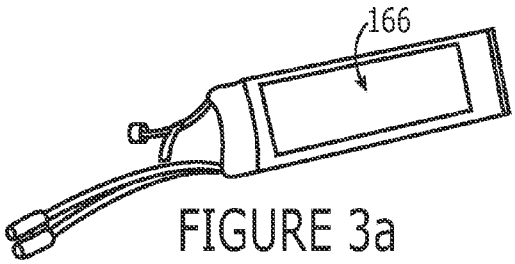
FIGS. 3*a-d* illustrates perspective views of inflation system components.
Figure 3B:
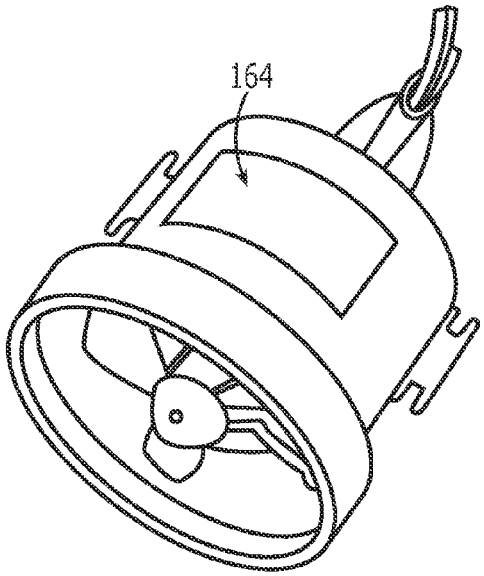
Figure 3C:
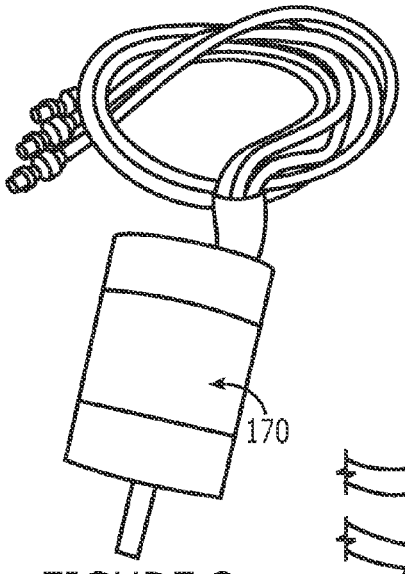
Figure 3D:
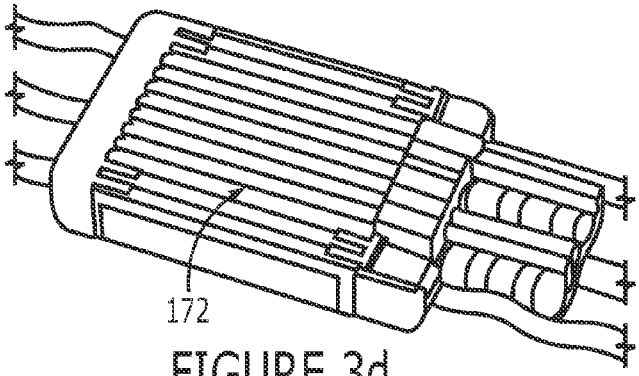

The inflation system 160 is configured to transition the inflatable chamber 140 from the compressed state to the inflated state. The inflation system 160 may further include an air intake 180, a fan 164, a battery 166, an internal airway channel 168, a motor 170, and a controller 172. The air intake 180 provides an inlet for receiving ambient air. The illustrated air intake 180 includes an elongated vent structure through which ambient air may transmit. The air intake 180 is coupled to the internal airway channel 168 such that ambient air may be transmitted through the air intake 180 to the internal airway channel with minimal loss. The components and operation of the air intake will be described in more detail with reference to FIG. 5 below. The fan 164, battery 166, motor 170, and controller 172 are the electrical components of the inflation system. The electrical components of the inflation system 160 are electrically coupled to the activation system as illustrated in FIG. 2. The fan 164 is a rotational member configured to generate a vacuum force in a particular orientation upon rotation. The fan is oriented in the system 100 to generate the vacuum force such that ambient air is pulled into the inflatable chamber 140. It will be appreciated that fans in a variety of sizes may be used in accordance with embodiments of the present invention. The battery 166 may be any form of electrical storage device. The motor 170 converts electrical energy into mechanical rotation. The controller 172 may be any form of speed controller to facilitate particular inflation patterns such as a logarithmic increase in fan speed. The fan 164, battery 166, motor 170, and controller 172 are selected to correspond with one another to facilitate optimal inflation characteristics. For example, the size of fan 164 dictates the necessary speed and time required to inflate the inflatable chamber 140. The speed and time parameters thereby influence optimal selection of the remaining electrical components.

The activation system 190 is configured to activate the inflation system 160 to inflate the inflatable chamber 140 to the inflated state. The activation system 190 is a user input device configured to a user-triggered action intended to activate the system 100. The particular user-triggered action depends on the specific type of activation system components. For example, the activation system 190 may include some form of physical switch configured to receive a physical switching motion from the user to activate the system 100. The switch may be any type of switching mechanism including but not limited to a rip cord, push button, toggle, etc. The activation system 190 is electrically coupled to the inflation system 160 so as to engage the inflation system upon receipt of the user-triggered action. Alternatively or in addition, the activation system 190 may include other sensors to activate the system without a user-triggered action. In addition, the activation may include a deactivation switch. The deactivation switch may be used to deactivate the system in the event of an inadvertent activation.

Figure 6:
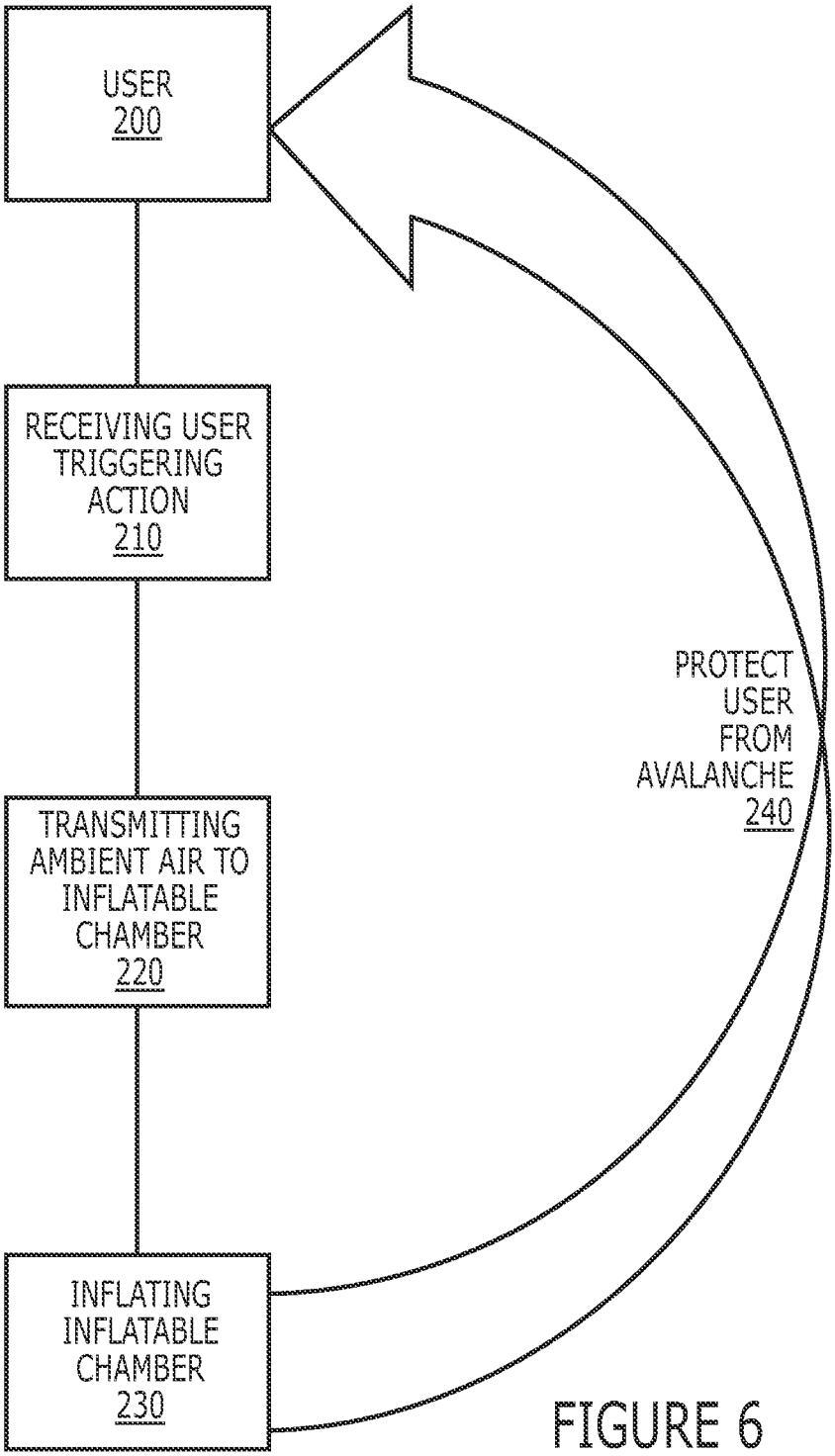
FIG. 6 illustrates a flow chart of a method in accordance with another embodiment of the present invention.
Figure 7A:
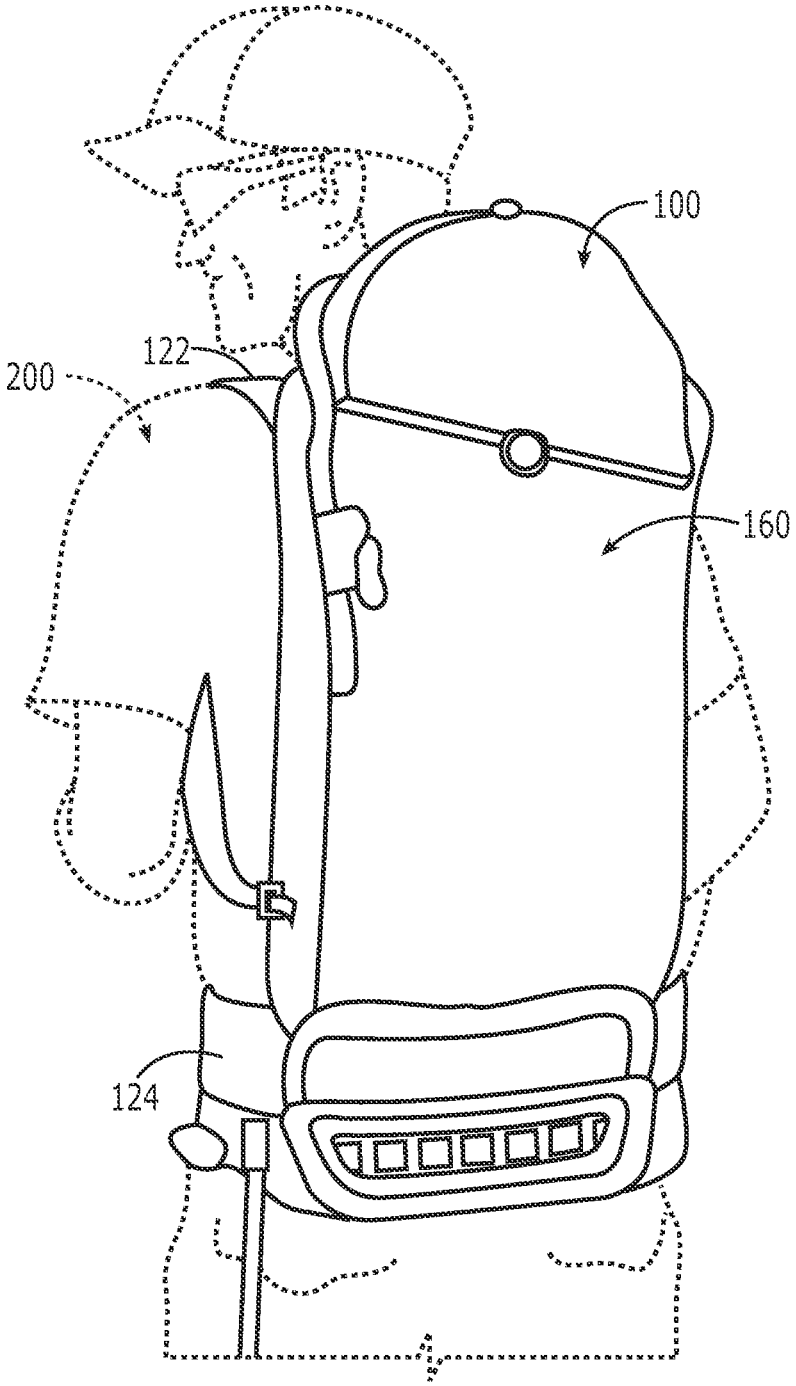
FIGS. 7A-7C illustrate an operational sequence of the system in FIG. 1 and the method of FIG. 6.
Figure 7B:
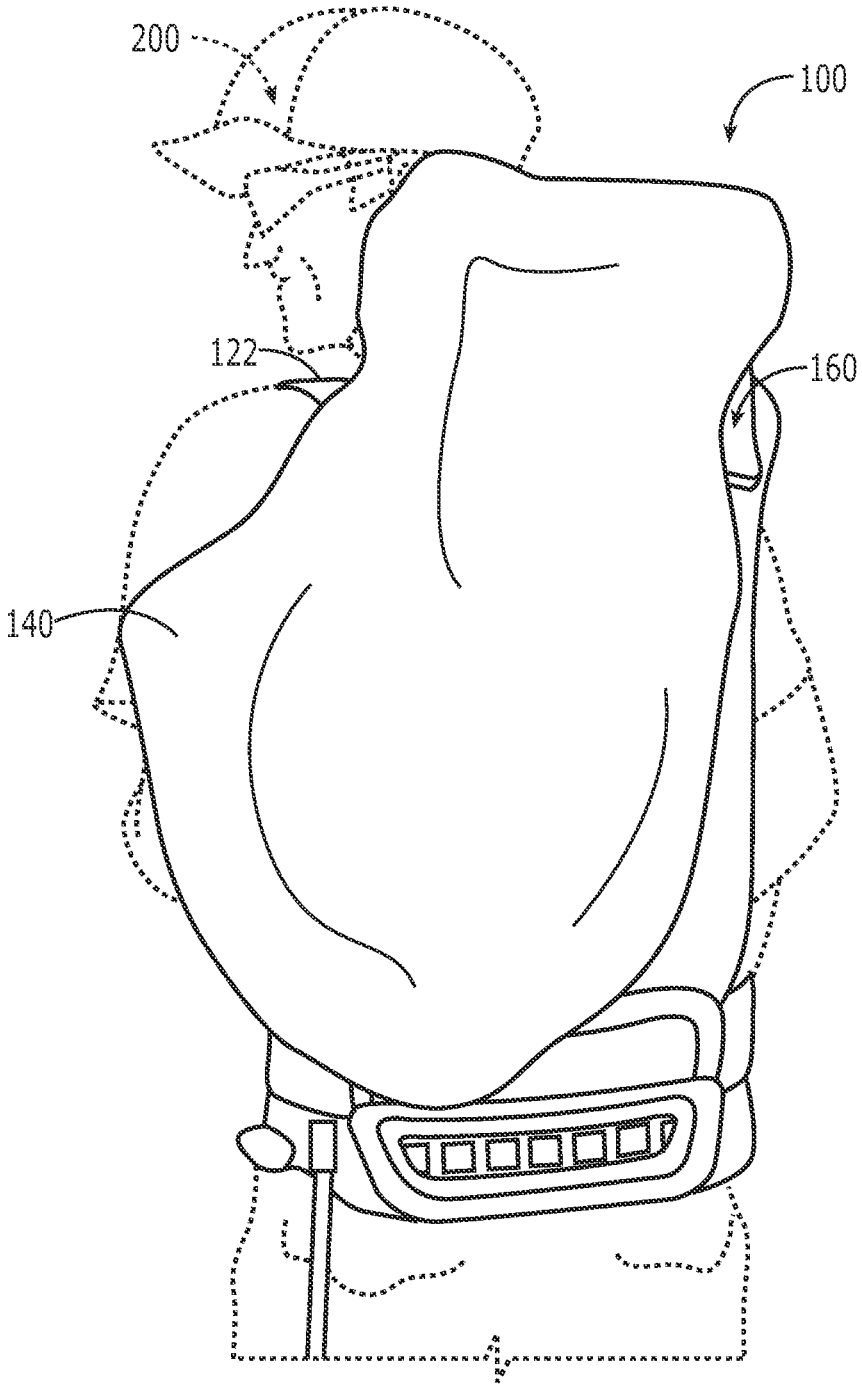
Figure 7C:
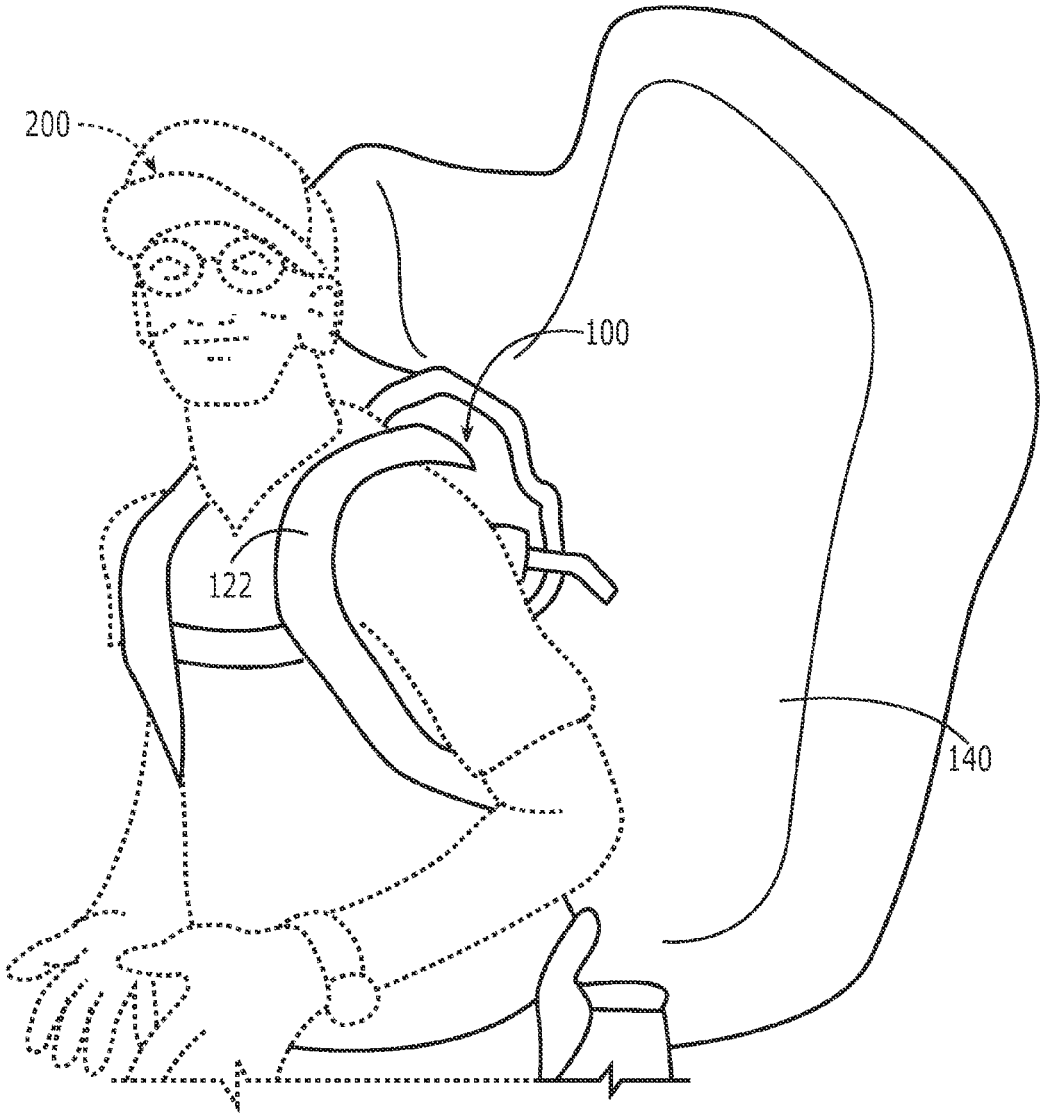

The harness 120 couples the system 100 to the user 200 as illustrated in FIGS. 7A-7C. The illustrated harness 120 in FIGS. 1-7 is a backpack including a hip strap 124 and a shoulder strap 122. The backpack configuration provides an internal chamber separate from the inflatable chamber 140 within which the user may store items. The internal chamber is disposed between the user and the inflatable chamber 140 such that the inflatable chamber is distally disposed with respect to the remainder of the harness/backpack 120 and the user. Therefore, upon activation the inflatable chamber will be able to inflate without obstruction. The inflation system 160 is distal to the inflatable chamber 140 in the illustrated embodiment. The inflation system 160 may be disposed within a region configured to break away or articulate upon the inflation of the inflatable chamber 140, as illustrated in FIGS. 7A-C. The backpack or harness may further include various other straps and compartments in accordance with embodiments of the present invention. Alternatively, the harness may be any form of simple strap structure configured to couple the system to the user.

Reference is next made to FIG. 2, which illustrates a schematic of the avalanche safety system illustrated in FIG. 1. The schematic diagram illustrates the operational relationship between various components of the system 100. The activation system 190 includes a switch 192. As discussed above, the activation system 190 is configured to receive a user-triggered action intended to activate the avalanche safety system 100 and inflate the inflatable chamber 140. The switch 192 is electrically coupled to the inflation system 160 between the battery 166 and the controller 172. As described above, the battery 166 stores electrical energy for use in inflating the inflatable chamber 140. The controller 172 is electrically coupled between the battery 166 and the motor 170. The controller 172 may provide a particular electrical inflation profile including modulating current with respect to time. The motor 170 is electrically coupled to the controller 172 and fan 164 such that the modulated current from the controller 172 may be converted to mechanical rotation of the fan 164. The fan 164 is mechanically disposed between the air intake 180 and the inflatable chamber 140. In particular, an internal airway channel 168 interconnects the air intake 180, fan 164, and inflatable chamber 140 so as to minimize air loss. As discussed above, upon activation, the fan 164 generates a rotational force that creates a vacuum aligned with the illustrated arrows. The vacuum pulls external ambient air through the air intake 180, the fan 164, and into the inflatable chamber 140.

Reference is next made to FIGS. 3*a-d*, which illustrate perspective views of inflation system components. The battery 166 may be any type of electrical storage device including but not limited to a direct current battery of the type illustrated. The fan 164 may be a circular fan that facilitates engagement with the internal airway channel 168. The motor 170 may be any type of motor 170 configured to correspond to the battery 166 and controller 172 parameters. Likewise, the controller 172 may be configured according the inflation objectives for the inflatable chamber 140.

Figure 4:
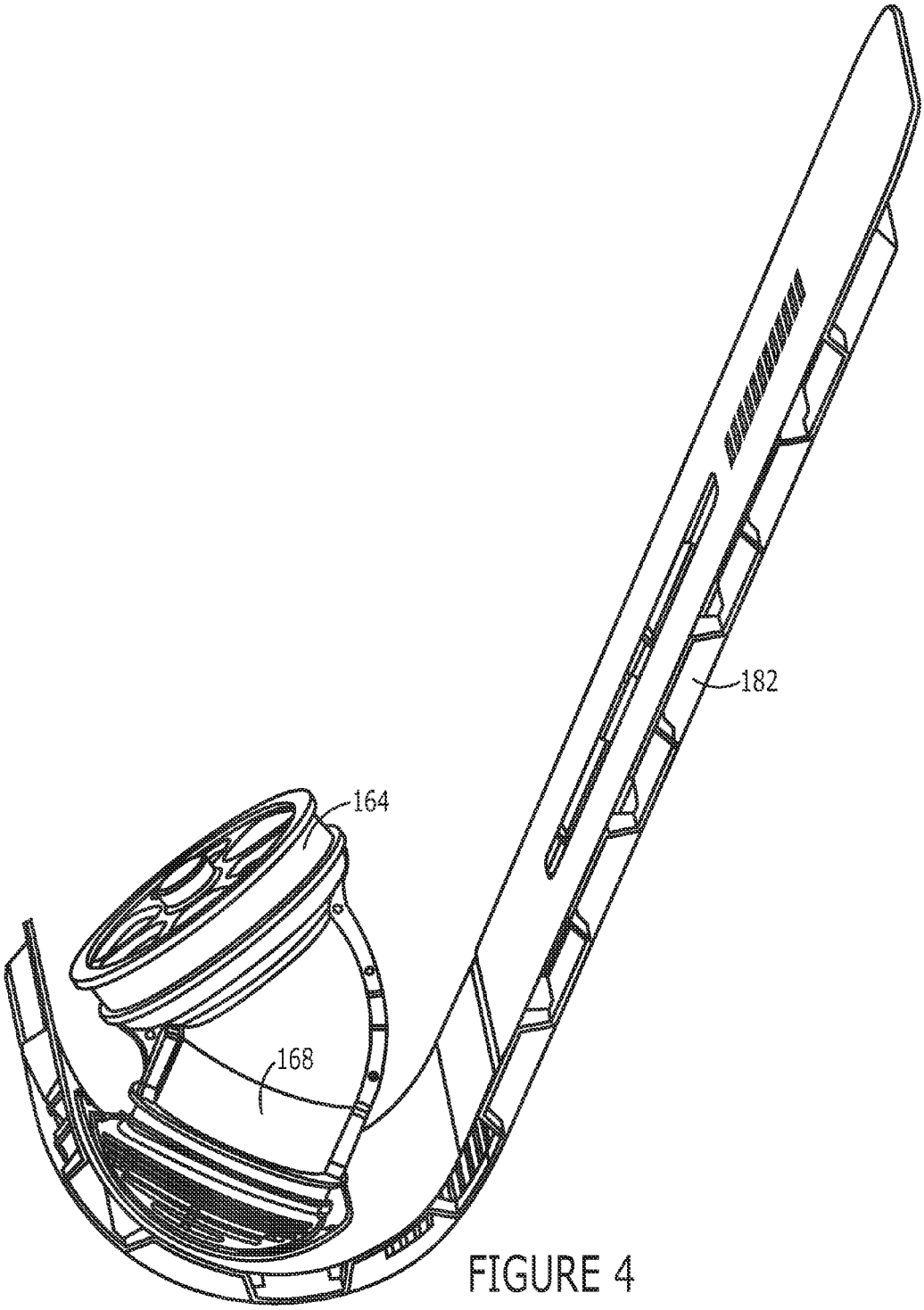
FIG. 4 illustrates a perspective view of the air intake frame, internal airway channel, and fan.

Reference is next made to FIG. 4, which illustrates a perspective view of the air intake frame 182, internal airway channel 168, and fan 164. The air intake frame 182 is part of the air intake 180. Various other air intakes may also be utilized including but not limited to the sides, bottom and front of the system 100. Increasing the number of air intake regions increases reliability of air intake during operation. The air intake frame 182 is a partially rigid member with a lateral vent structure as illustrated. In particular, the lateral vent structure includes a channel to the internal airway channel 168. Therefore, air/gas transmitted through the lateral vents may be routed to the internal airway channel 168. The air intake frame 182 includes rigid internal structure members to maintain the channel. The illustrated internal airway channel 168 is a cylindrical member coupled between the air intake frame 182 and the fan 164. The internal airway channel 168 substantially encloses the coupling so as to minimize air leakage between the air intake frame 182 and the fan 164. The fan 164 is coupled to the internal airway channel 164. The inflatable chamber 140 (not shown in FIG. 4) is coupled to the fan 164 either directly or via another internal airway channel member (not shown).

Figure 5:
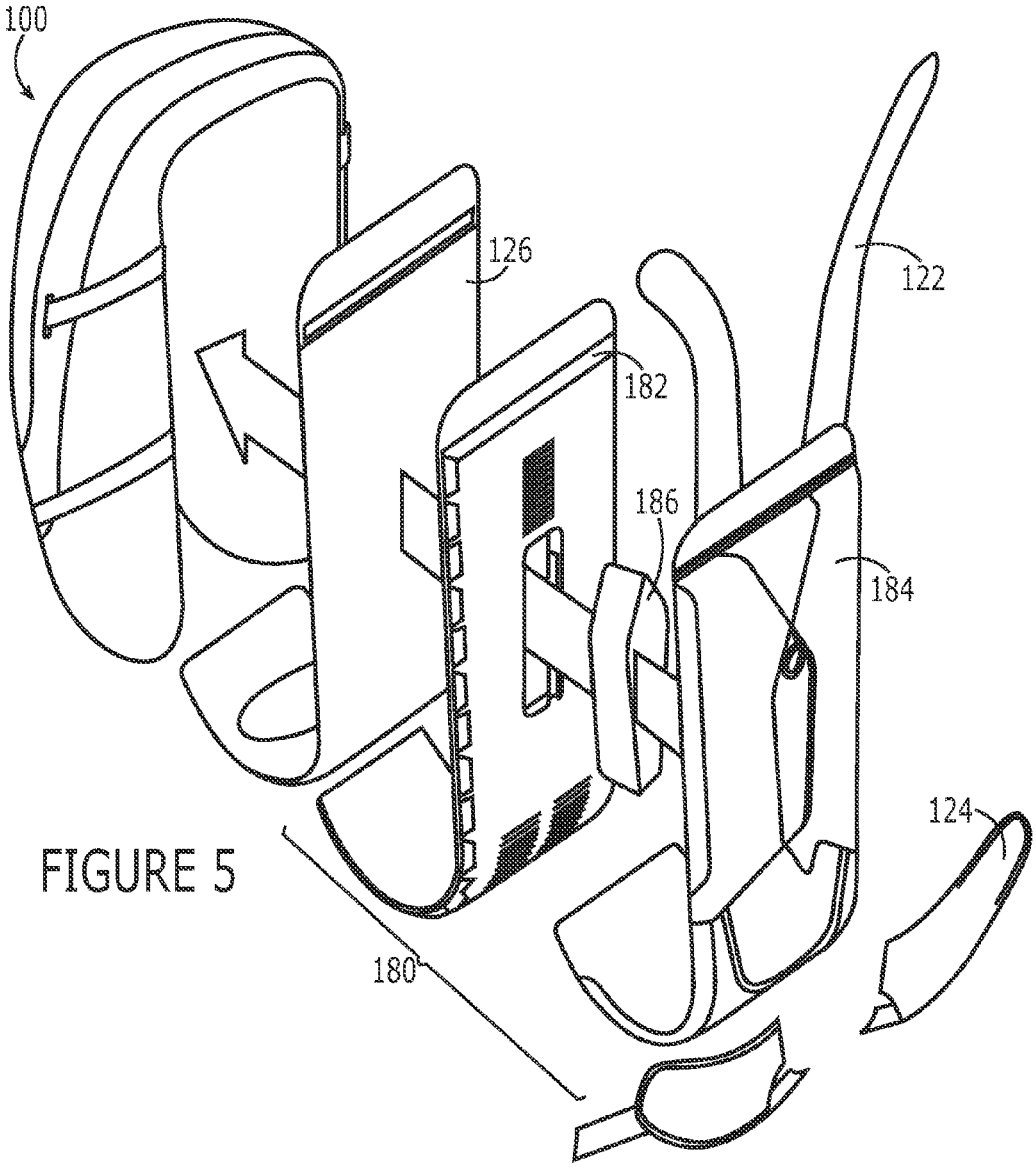
FIG. 5 illustrates an exploded view of the air intake with respect to the remainder of the avalanche safety system.

Reference is next made to FIG. 5, which illustrates an exploded view of the air intake 180 with respect to the remainder of the avalanche safety system. The air intake 180 includes the air intake frame 182 (illustrated in FIG. 4), a battery compartment 186, and a cover 184. The battery compartment 186 is configured to be disposed within the air intake frame 182. The positioning of the battery compartment 186 and the battery (not shown) with respect to the user is important because of the relative weight of most batteries. Therefore, positioning the battery 164 in a central region enables the shoulder 122 and hip straps 124 of the backpack (harness 120) to efficiently support the battery during operation. In addition, the battery 164 must be kept above a certain temperature for proper operation, and therefore positioning adjacent to the user ensures some amount of thermal insulation from the ambient temperature. The cover 184 includes padded regions and mesh regions. The padded regions facilitate user comfort and are disposed between the user and the air intake frame 182. The mesh regions are oriented to align with the lateral venting structure of the air intake frame 182. Therefore, ambient air may transmit through the mesh regions and into the air intake frame 182 as discussed above. Likewise, the mesh regions prevent debris from obstructing the vent structure of the air intake frame 182.

FIG. 5 further illustrates a frame 126 member of the backpack or harness 120. The frame 126 may include a rigid support region for further supporting the system with respect to the user. The exploded view illustrates the positioning of the air intake 180 and the frame 126 with respect to the remainder of the system 100. The hip/waist straps 124 and the shoulder straps 122 are also illustrated in the exploded view for positional reference.

Reference is next made to FIG. 6, which illustrates a flow chart of a method in accordance with another embodiment of the present invention. The method for inflating an inflatable chamber within an avalanche safety system comprises a plurality of acts. The illustrated method may be performed using the avalanche safety system 100 described above or in correlation with an alternative avalanche safety system. The method receives a user-triggered action intended to activate the avalanche safety system, 210. The act of receiving the user-triggered action may include receiving a physical operation or gesture such as pulling a ripcord or depressing a button. Alternatively, the act of receiving a user-triggered action may include receiving a non-physical operation. Upon receipt of the user-triggered action, the method transmits ambient air to the inflatable chamber, 220. The act of transmitting ambient air to the inflatable chamber may include generating a vacuum that transmits ambient air through an internal airway channel to the inflatable chamber. The act of generating a vacuum may include using a fan and/or other electrical components. The inflatable chamber is inflated, act 230. The act of inflating the inflatable chamber may include inflating entirely with ambient air. The act of inflating the inflatable chamber may also include forming a particular three dimensional shape and internal pressure of the inflatable chamber. The inflation of the inflatable chamber thereby protects the user from an avalanche, act 240. The act of protecting the user from an avalanche may include cushioning the user from impact during the avalanche, elevating the user above the avalanche, and/or providing a breathing receptacle of ambient air.

Reference is next made to FIGS. 7A-7C, which illustrate an operational sequence of the system in FIG. 1 and the method of FIG. 6. FIG. 7A illustrates a user 200 with an avalanche safety system 100 in accordance with embodiments of the present invention. In particular, the user 200 is wearing the system 100 via a backpack harness structure including a set of hip/waist straps 124 and shoulder straps 122. The system includes an activation system 190 (not shown), inflation system 160 and inflatable chamber 140 as described above. FIG. 7A illustrates the inflatable chamber 140 in the compressed state so as to be contained within a region of the backpack. In addition, the system illustrated in FIG. 7A has not been activated and therefore the user has not performed any type of user-triggered action upon the activation system 190. Prior to FIG. 7B, the user performs a particular user-triggered action such as pulling a ripcord or pressing a button to activate the system 100. As described above, the activation system includes an electrical coupling that activates the components of the inflation system 160. For example, activation of the activation system 190 may include switching a switch so as remove electrical resistance between a battery and other electrical components. Upon activation, the inflation system 160 transmits ambient air to the inflatable chamber 140. FIG. 7B represents the transition from the compressed state to the inflated state of the inflatable chamber 140. The inflatable chamber 140 is partially filled with ambient air directed through an air intake 180, internal airway channel 168, and fan 164. A controller 172 may be used to inflate the inflatable chamber 140 according to a particular inflation profile. The inflation system 160 automatically translates in response to the inflation of the inflatable chamber 140. In the illustrated embodiment, the inflation system 160 is disposed within a region that is translating to the right as the inflatable chamber 140 is expanding. The inflation system 160 may be housed within a region with a releasable coupling (such as VELCRO) to the remainder of the system, thereby enabling automatic displacement in response to inflation. FIG. 7C illustrates complete transition to the inflated state of the inflatable chamber 140. The inflatable chamber 140 thereby forms a particular three dimensional shape and has a particular pressure. The particular three dimensional shape and pressure of the inflatable chamber are specifically selected to protect the user 200 from impact and provide flotation during an avalanche. Various alternative shapes and pressures may be utilized in accordance with embodiments of the present invention. The pressure within the inflatable chamber may be maintained for a particular time using a one way valve that seals the inlet from transmitting air out from the inflatable chamber 140. Likewise, the controller 172 may be configured to shut off and/or restart the fan 164 after a certain amount of time corresponding to complete inflation of the inflatable chamber 140.

It should be noted that various alternative system designs may be practiced in accordance with the present invention, including one or more portions or concepts of the embodiment illustrated in FIG. 1 or described above. Various other embodiments have been contemplated, including combinations in whole or in part of the embodiments described above.

What is claimed is:

1. An inflatable avalanche safety system comprising:

an inflatable chamber including a compressed state and an inflated state, wherein the inflated state forms a pressurized three dimensional region in non-encasing external proximity to a user;

an inflation system configured to inflate the inflatable chamber from the compressed state to the inflated state with entirely external ambient air, wherein the inflation system includes a fan selectively electrically coupled to a battery;

an activation system configured to activate the inflation system; and a harness configured to support the inflatable chamber, activation system, and inflation system in proximity to the user, wherein the fan is disposed within a bottom half of the harness;

wherein the inflation system includes an air intake disposed on an external surface of the harness.

2. The system of claim 1, wherein the air intake, fan, and inflatable chamber are coupled via an internal airway channel.

3. The system of claim 1, wherein the activation system is configured to activate the inflation system in response to a user-triggered action.

4. The system of claim 1, wherein the activation system includes an electrical switch configured to selectively transmit an electrical current from a battery to a fan.

5. The system of claim 1, wherein the harness includes a backpack within which inflatable chamber is disposed in the compressed state, and wherein the inflation system is disposed within the backpack.

6. An inflatable avalanche safety system comprising:

an inflatable chamber including a compressed state and an inflated stated, wherein the inflated state forms a pressurized three dimensional region around a user;

an inflation system configured to inflate the inflatable chamber from the compressed state to the inflated state with a fan;

an activation system configured to activate the inflation system; and a harness configured to support the inflatable chamber, activation system, and inflation system in proximity to the user, wherein the inflation system includes an air intake disposed on an external surface of the harness, wherein the inflatable chamber is supported entirely on a dorsal side of the user with the harness.

7. The system of claim 6, wherein the inflation system is configured to inflate the inflatable chamber entirely external ambient air.

8. The system of claim 6, wherein the fan is selectively electrically coupled to a battery.

9. The system of claim 6, wherein the air intake, fan, and inflatable chamber are coupled via an internal airway channel.

10. The system of claim 6, wherein the activation system is configured to activate the inflation system in response to a user-triggered action.

11. The system of claim 6, wherein the activation system includes an electrical switch configured to selectively transmit an electrical current from a battery to a fan.

12. The system of claim 6, wherein the harness includes a backpack within which inflatable chamber is disposed in the compressed state, and wherein the inflation system is disposed within the backpack.

13. An inflatable avalanche safety system comprising:

an inflatable chamber including a compressed state and an inflated stated, wherein the inflated state forms a pressurized three dimensional region around a user in a non-encasing external configuration;

an inflation system configured to inflate the inflatable chamber from the compressed state to the inflated state with an electrically powered component, wherein the electrically powered component is a fan selectively electrically coupled to a fan;

an activation system configured to activate the inflation system;

a harness configured to support the inflatable chamber, activation system, and inflation system in proximity to the user;

wherein the inflation system includes an air intake disposed on an external surface of the harness; and wherein the air intake and fan are disposed in at least one of a proximal middle and proximal lower region of the harness with respect to the user.

14. The system of claim 13, wherein an air intake, a fan, and the inflatable chamber are coupled via an internal airway channel.

15. The system of claim 13, wherein the harness includes a backpack within which inflatable chamber is disposed in the compressed state, and wherein the inflation system is disposed within the backpack.

* * * * *